US006684791B1

(12) United States Patent
Barnhart

(10) Patent No.: US 6,684,791 B1
(45) Date of Patent: Feb. 3, 2004

(54) SHAPED CHARGE DETONATION SYSTEM AND METHOD

(76) Inventor: Charles R. Barnhart, 6901 Valley View Pl., Cheyenne, WY (US) 82009

( * ) Notice: Subject to any disclaimer, the term of this patent is extended or adjusted under 35 U.S.C. 154(b) by 0 days.

(21) Appl. No.: 09/589,132

(22) Filed: Jun. 8, 2000

(51) Int. Cl.[7] ..... F42B 1/02; F42B 3/08
(52) U.S. Cl. ..... 102/307; 102/331; 102/323
(58) Field of Search ..... 102/323, 331, 102/307

(56) References Cited

U.S. PATENT DOCUMENTS 1,562,123 A * 11/1925 Pitts ..... 102/331
2,087,209 A * 7/1937 Lahey et al. ..... 102/331 X
2,353,458 A * 7/1944 Greene ..... 102/331
3,371,605 A * 3/1968 Eckels ..... 102/331
3,926,119 A * 12/1975 Hurst et al. ..... 102/331 X
4,938,143 A 7/1990 Thomas et al. ..... 102/318
5,308,149 A * 5/1994 Watson et al. ..... 102/307 X
5,705,768 A 1/1998 Ey ..... 102/307

* cited by examiner

*Primary Examiner*—Peter A. Nelson

(57) ABSTRACT

Encapsulated shaped charge for efficient initiation of hydrodynamic velocity detonation of explosives column. A water tight capsule with angled sides containing sufficient quantities of explosive and a detonator means where the capsule substantially occupies the cross-section of the bore-hole. The capsule contains up to 30 pounds of explosives. The capsule efficiently and sufficiently initiates a column of explosives whereby the amount of Nitrogen Dioxide is substantially decreased.

31 Claims, 5 Drawing Sheets

SHAPED CHARGE DETONATION SYSTEM AND METHOD

BACKGROUND OF THE INVENTION

This invention relates to shaped charges and to the use of shaped charges in explosive blasting and in particular to the reduction of Nitrogen Oxides from explosive blasting in the mining industry.

The art of shaping a detonation charge to do work is a very well documented process. Explosions used to perforate well casings, heavy armor piercing shells and fireworks are all examples of shaping explosive energy.

In prior art blasting techniques a booster or primer is mainly used to further initiate a less sensitive blasting agent. The boosters usually range from one to five pounds in weight and are available in several compositions and shapes. During blasting a detonator or booster is used to provide a sufficient amount of energy to the blasting agent in order to initiate a sustained reaction in the blasting agent which travels from the point of initiation, usually the bottom of a bore-hole, through the entire column of blasting agent. The dynamics of the reaction in the blasting agent depend on the amount, shape and direction of the energy produced by the detonator or booster.

The direction of the initiation energy has many effects. Ideally the initiation energy produced by the detonator or booster directs the energy upward to the column of blasting agent and does not direct energy downward toward mineral strata. This protects the strata from damage yet accomplishes the initiation of the blasting agent column. In a shape charge booster the energy is also directed upward and not outward radially. If energy is directed radially outward, other bore-holes may be damaged.

The shape of the initiation energy has significant effects on the overall blast as well. The shape of the energy wave produced by the booster or detonator often determines the dynamics of the reaction of the column of blasting agent. As shown in U.S. Pat. No. 4,938,143, the increase in surface area of the contact between the blasting agent column and the booster partially determines whether the blast is over-driven or underdriven. This corresponds to the reaction dynamics and the overall effectiveness of the blast. The ideal reaction of the column of blasting agent is one that reaches hydrodynamic velocity or steady state velocity immediately at the point of initiation. By shaping the initiation energy wave a steady state velocity is reached more quickly and the efficiency or effectiveness of the blast is improved. Additionally, the initial shape of the energy wave produced assists in detonating the entire cross-section of the column of blasting agent. As opposed to a narrow lance of directed energy, by projecting the energy wave to encompass the sides of the blasting agent column the initiation energy initiates the entire cross-section of the column and produces a more desirable reaction traveling up the blasting agent column.

The amount of energy produced by a booster or detonator is also a concern for the efficient and sufficient detonation of the blasting agent column. The amount of energy produced by a booster should be enough to effectively initiate the column of blasting agent, but not so much as to affect the mineral strata, other bore-holes or the reaction of the column of blasting agent. Too much energy from the initiation may produce a blow-out or other effects that do not react the column of blasting agent. By controlling the amount shape and direction of the initiation energy a blast's efficiency and effectiveness is controlled for the desired results.

Often the conditions present in blasting greatly affect the efficiency of the blast. During blasting operations bore-holes are drilled and set with detonation means, booster means or both and then the blasting agent is supplied into the bore-hole before the detonation of the explosives. In some instances the blasting agent lies in the bore-holes for considerable time before the detonation. Often the blasting agent is adversely affected when allowed to sit for extended periods of time. The adverse effects are most profound near the bottom of the bore-holes where any water or other contaminants collect and the detonation or boosting means is located. The adverse effects seen in bore-holes may be wetting of the blasting agent, breaks or discontinuities in the basting column or other effects. When adverse conditions are present in blasting the use of prior art shaped boosters and detonators does not lead to the desired results that is the efficient initiation of the blasting agent. If the blasting agent surrounding and immediately atop the boosters or shaped charges is adversely affected by conditions present in the bore-hole, the shaped charge or booster directs a shock wave at blasting agent which does not sufficiently propagate the desired shock wave or reaction. The boosters in use may shape the energy wave correctly but the size of the initial detonation is normally not sufficient in order to overcome effects of the conditions present in the bore-holes.

When using blasting as a tool for mining or other industries the bore-holes are sometimes angled, to effectuate a desired use of the energy released during blasting. Often the angled bore-holes adversely affect the results of the blast. Blasting agent may settle to one side of the bore-holes. When using prior art type boosters the orientation of the booster is critical in obtaining efficient use of the explosives. In angled bore-holes the orientation of most prior art boosters are suspect. When a small shaped charge or booster is placed in a bore-hole, the booster or charge aligns with gravity forces and is often directed out of the perpendicular cross-section of the explosives column. While the prior art mentions the critical orientation of the shaped charge in relation to the cross-section of the blasting column it does not mention the means of achieving such orientation of the booster in the bore-holes and in particular the orientation in angled bore-holes.

Shaped charge detonation is a technique known to the mining industry, and almost all of the manufacturers of cast boosters sell a shaped booster for various applications. The art of shaping a charge is thoroughly explained in U.S. Pat. No. 4,938,143. U.S. Pat. No. 4,938,143 provides experimental proof that "steady state velocity" is reached as quickly as possible with shaped detonation. Though it is not explained in the patent, molten explosives were poured into a conical shaped mold and then solidified to make the shaped booster. U.S. Pat. No. 5,705,768 takes the invention in U.S. Pat. No. 4,938,143 one-step further by adding a shaped form on top of a cast booster. This invention fills the cylindrical end with inert material rather than explosive. The explosive incorporated into the design is a conical form at the top of the device. The explosive is conical shaped, and the resulting explosion is shaped because it takes the form of the cone through which the energy is broadcast. It also addresses the use of shaped charges to more effectively initiate the blast to remove overburden from mineral strata. In U.S. Pat. No. 5,705,768, the shaped charge directs energy with the use of a concave recess atop the shaped charge whereby the energy wave is broadened outwardly and up through the powder column. However, the arrangement disclosed in U.S. Pat. No. 5,705,768 does not solve orientation problems within bore-holes or address blast initiation of the entire cross section of the powder column to achieve faster steady state or hydrodynamic velocity. Though U.S. Pat. No. 5,705,768 does not have experimental findings it does reference U.S. Pat. No. 4,938,143 as the document to prove the value of the shaped charge. In fact, the technique of shaping a detonation is well known in the art. U.S. Pat. No. 4,938,143 is hereby incorporated by reference to demonstrate that shaped detonation is more efficient.

The present art is specific to casting explosive material in various shapes, the largest of which is 4 pounds. Research has demonstrated that a shaped booster is far more efficient in obtaining hydrodynamic velocity than the commonly used cylindrical booster; however, the shaped booster is not successfully used in cast blasting. The disadvantage of the present art is that a small booster will not be orientated correctly when it reaches the bottom of a bore-hole. If the shaped detonator were upside down it would extremely compound the problem of low detonation velocity and concern about orientation may be the primary reason for not using the existing technology. Although shaped boosters are not being used in cast blasting the low profile boosters are. These flat boosters are being used like a shaped charge booster because they have a large surface area in contact with the Ammonium Nitrate blasting agent. This large area spreads the energy across the face of the powder column, just as the shaped charge would do, but there is no fear of incorrect orientation with this type of symmetrical booster.

According to the prior art, shaped boosters of many designs address the need for attaining a steady state velocity of the explosive wave front within inches of the booster. Additionally, some of the prior art addresses the need for shaping the wave front produced by the booster in order to obtain a more efficient blast. However, the prior art does not address the initiation of the entire cross-section of the explosives column with sufficient energy to overcome adverse conditions.

In addressing the efficiency, effectiveness and sufficiency of a blast, a specific problem with blasting is also addressed. In many blasts the production of pollutants is of great concern. The pollutants are a direct result of an improper reaction occurring during detonation. Particular blasting agents have a tendency to produce environmental pollutants during and after a blast is initiated. In particular, ANFO produces orange clouds of Nitrogen Dioxide. Although much of the description is directed toward the production of pollutants from an Ammonium Nitrate Fuel Oil (ANFO) blast, the illustration of the reaction is equally applicable to other types of explosives and their consequent improper detonation reactions. Similarly, the use of explosives is emphasized by way of example for the mining industry and in particular the coal mining industry. However, the discussion and invention are applicable to other uses of explosives and any limitation contained herein is for illustration purposes.

The surface mining industry has long been plagued by the formation of toxic Nitrogen Dioxide from Ammonium Nitrate and fuel oil blasts, but more so with the now common technique of Cast Blasting. The Cast Blast pattern is set up to throw the overburden (dirt) off of the coal seam, which allows the mine to produce more tons of coal at a reasonable cost. The: problem with Cast Blasting is that the ANFO columns are 100 feet deep and the blasting agent must be put into the bore-hole days before the blast. The longer the ANFO is in the bore hole the greater the chance the blasting agent immediately around the detonator is affected by temperature, pressure and water. If the blasting agent integrity is compromised around the detonator, the blasting agent does not ignite with sufficient energy and noxious Nitrogen Dioxide gases are formed. The Nitrogen Dioxide is very visible as large clouds of orange smoke.

Clouds of Nitrogen Dioxide gas have become common and severe since the cast blasting technique was introduced. Although changes in blasting schemes have helped reduce the Nitrogen Dioxide, the pollutant still has not been eliminated and the mining industry's profitability is being affected.

Deflagration and the subsequent Nitrogen Dioxide ($NO_2$) formation is not a new problem, but the magnitude of the problem has intensified to become an environmental concern. In 1994, the technique called cast blasting began to be the standard practice for breaking up the overburden to get to coal seams. Not only did the technique make the dirt shoveling easier; it cast 35% of the dirt into the mined out trough so that it did not have to be shoveled at all. However, it is the cast blasting technique that became notorious for producing huge clouds of Nitrogen Dioxide gas with every blast. An estimate of the concentration of Nitrogen Dioxide in a typical "orange cloud" is about 1,000 pounds and this new source of Nitrogen Dioxide has become a significant environmental concern as well as a public health threat.

The change from load-and-shoot blasting to cast blasting has undoubtedly affected the chemistry of the blast and has lead to the creation of Nitrogen Dioxide clouds. The bore holes are three times deeper, the blasting agent "sleeps" in the ground for many days, and there is no way of knowing if the detonator is surrounded by active blasting agent at the bottom of these bore holes. It would appear that some basic principle of blasting was violated when cast blasting was introduced to some areas.

The particular type of blasting that has lead to the creation of the Nitrogen Dioxide problem is cast blasting. The blasting technique was investigated to determine the factors that might affect the chemistry. The sequence of a cast blast is disclosed below.

The cast blast is set up to kick the overburden off into the already mined out trough left by the coal seam. The bore holes are drilled at a 20° angle to ensure that the toe of the bench slides into the trough. The holes are pushed all the way to the coal seam and then back filled with ten feet of dirt to position the blast just above the coal seam. When the blast is detonated, the front row of holes initiates first. This breaks up the overburden and starts it moving outward and downward toward the trough. Blowing the front row provides relief for the next row so that the new blast wave can broadcast the dirt outward.

When the second row of holes is initiated the second relief of dirt follows the first. The cast blast is designed to be powerful enough to put the first relief of dirt in the trough and put about half the second relief of dirt on top of the first. A good cast blast should move 35% of the overburden off of the coal seam. The loosened rock or muck, blown into the trough, does not have to be shoveled. The first row will blow the hardest because the rock is still tight and the gas energy has a solid wall to push against. As each row blows the ground becomes fractured and fissures allow some of the gas energy to be lost, which limits the amount of cast achieved by the last row of holes. The third row detonation blows into the relief of the second row blast and drops the muck on top of the coal.

The cast blast results in a 45% cast. It is the success of the blasting program that dictates the overburden removal costs. The more dirt that is cast off of the coal seam the less dirt that must be shoveled. The overburden to coal ratio is an important economic number to coal mining, as is the cost per cubic yard to remove overburden. The end result of a cast blast is an orange cloud of Nitrogen Dioxide gas. The poisonous gas rises out of the muck pile for many minutes after a cast blast.

It is therefore an object of at least one aspect of the present invention to address the problems and disadvantages above.

It is an object of the present invention to overcome the adverse conditions often times present in bore-holes and to supply a device which ensures a large amount of dry or unaffected blasting agent for sufficient initiation of the blast.

Another object of the present invention is to provide an effective shaped charge for use in the explosives and mining industry.

Yet another object of the present invention is to address the need to increase detonation power to reach steady state velocity as quickly as possible.

It is an object of the present invention to provide a capsule for the blasting industry that is not an explosive but can be made into a shaped explosive charge by the user or blaster.

It is also an object of the present invention to provide a device that does not require special care to orientate the shaped charge toward the powder column.

Another object of the present invention is to provide a device that can be added on top of the existing system to enhance the detonation of the booster.

Yet another object of the present invention is to provide a device that can slide down an angled bore-hole and orient the shaped charge toward the powder column.

Still another object of the present invention is to provide a device that has enough weight to ensure it reaches the bottom of a bore-hole greater than 100 feet deep.

It is an object of the present invention to provide a device that can be made to have a density greater than water so it can sink through water.

Another object of the present invention is to provide a device to ensure that the blast energy of the detonator contacts 25 pounds of blasting agent that has not been compromised by temperature, pressure and/or water.

Still another object of the present invention is to provide a device that ensures that the blasting agent in intimate contact with the booster does not diffuse into the formation.

Yet another object of the present invention is to provide a device that can be added to the existing system when additional energy is needed.

It is an object of the present invention to provide a device that can be varied to deliver blast energy so the explosion is not overdriven or under driven.

It is an object of the present invention to overcome the adverse conditions often times present in bore-holes and to supply a device which ensures a large amount of dry or unaffected blasting agent for initiation of the blast.

It is yet another object of the present invention to initiate an entire cross section of a blasting agent column to produce a steady state hydrodynamic shock wave at or near the bottom or area of a capsule in order to completely fire the column efficiently.

Another object of the present invention is to provide a device that can be placed at varied points in the bore-hole to accelerate the energy as needed.

Other objects of this invention will become apparent from the following description.

BRIEF SUMMARY OF THE INVENTION

This invention is a shaped charge in the form of a capsule designed to contain high energy blasting agent. The capsule may be filled and shipped as an explosive device or may be shipped as a capsule and filled with explosives at or near the site of blasting by the end user or blaster. The present invention is a tool to augment the existing blasting technology. In the event of shipping the capsule not filled with any explosive materials it does not qualify as a munitions, ordinance, pyrotechnic, bomb and or any other DOT Class 1 material so it may be shipped at a reasonable cost anywhere in the world. The present invention is a shaped charge that utilizes a capsule to sufficiently, efficiently and effectively initiate a column of blasting agent. The filled capsule produces an initiation energy for a detonation of a column of blasting agent. The amount, shape and direction of the initiation energy is controlled by the capsule in order to efficiently and sufficiently react the blasting agent column for an effective blast. The present invention overcomes the conditions common in bore-holes such as contamination and corruption of the blasting agent and column, and the difficulties in the orientation of boosters and other initiators. The present invention also addresses the need for a large quantity of explosives to sufficiently and properly initiate a column of blasting agent. The present invention also reduces the amount of pollutants emitted by cast blasting.

This invention utilizes a capsule which shapes detonation energy to assure hydrodynamic velocity is reached closer to the initial site of detonation of the explosive blasting agent column and to prevent the formation of pollutants in mining blasts. By ensuring the detonation reaches hydrodynamic velocity at or near the initial site of detonation, the capsule increases the efficiency of the blasting agent column to achieve the desired results of the blast. Additionally, focusing the energy of the initial detonation at the blasting agent ensures the powder column reaches hydrodynamic velocity so it does not produce pollutants. The present invention provides a detonation system that can be used to solve the "orange smoke" problem in cast blasting.

This invention is a technical solution to the environmental problem and thus a solution to keeping the mining industry profitable. By initiating ANFO powder columns with concentrated energy, the formation of Nitrogen Dioxide is dramatically reduced. This invention is a plastic capsule that is to be filled with high energy blasting agent and fitted with a standard detonator means. The design of the capsule ensures that a large volume of blasting agent is protected from degradation and further ensures that the hydrodynamic velocity of the detonation is energetic enough to prevent Nitrogen Dioxide formation.

This invention is designed to address two other problems in the detonation of a bore-hole filled with blasting agent. The capsule is designed to protect up to 30 pounds of blasting agent from the affects of temperature, pressure and moisture at the bottom of the bore hole. The capsule further ensures that a commonly used cylindrical cast booster or other detonation means is in intimate contact with a sufficient amount of unadulterated blasting agent that will immediately initiate the powder column at hydrodynamic velocity. The capsule is shaped such that it projects the energy of the detonation directly at the column of blasting agent to spread the supersonic gas jet to the sides of the bore-hole. By providing the assurance that the detonator system will initiate with maximum energy, the Ammonium Nitrate will react completely and not form environmental pollutants. The capsule will protect and project the blast energy to ensure hydrodynamic velocity is obtained at the bottom of the blast hole or at the capsule location.

DETAILED DESCRIPTION OF THE INVENTION

Figure 2:
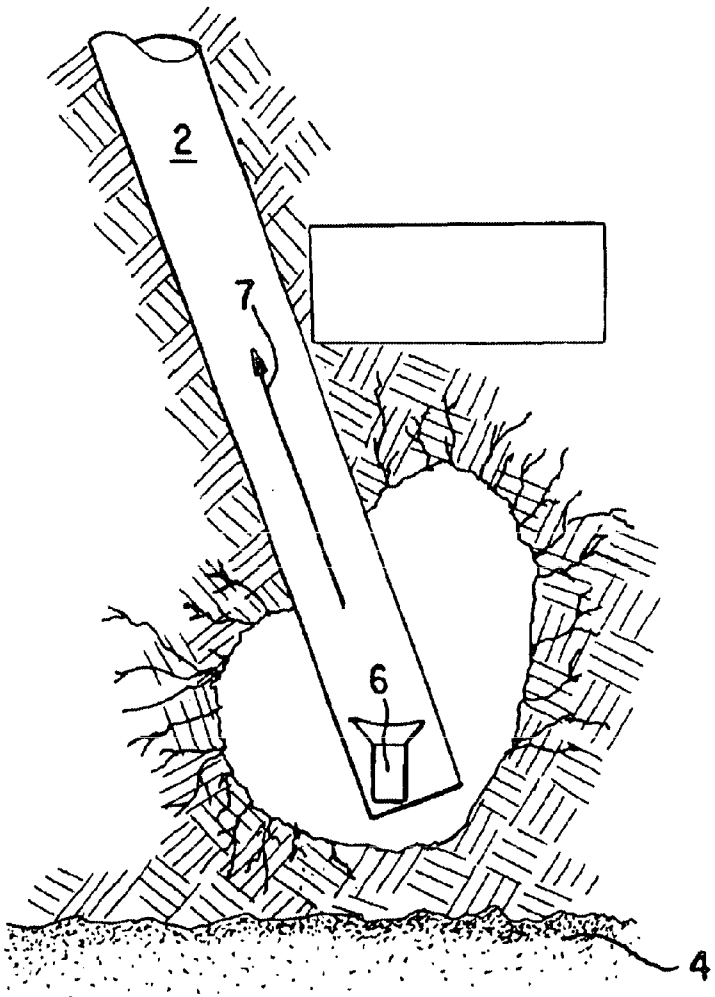
FIG. 2 is an illustration of a resultant blast initiated by a shaped charge booster.

It should be appreciated that this invention is described by way of example and that modifications and improvements may be made to the invention without departing from the scope thereof as defined by the claims. The present invention sets out to solve the problems of blasting by producing an initiation detonation that is shaped, directed and sufficient to efficiently react and detonate a column of explosives or blasting agent. The problem of the production of pollution from blasting is also solved by the control of the blast reaction dynamics by this detonation system.

The idea that Nitrogen Oxide formation can be stopped with a shaped energy detonation is novel to the present invention. Consequently, this disclosure will review the chemistry for the creation of Nitrogen Oxides from ANFO blasts and how detonation energy solves the problem.

The objective in reducing Nitrogen Dioxide formation is to promote detonation and avoid deflagration. The chemical reaction in the Ammonium Nitrate/Fuel Oil explosive is the extremely rapid (explosive) burning of particles. There are many factors that affect how quickly the particles burn; however, there is more than just burning that occurs in the detonation process. The rapid burning of the powder column must be initiated by a shock wave of sufficient heat and pressure to drive the reaction and, in turn, the burn must continue to propel the shock wave to sustain the detonation. This burning occurs at a supersonic speed during detonation and subsonic speed during deflagration. The supersonic shock wave travels through the powder column just ahead of the fire front and brings the ANFO to an optimum state of reactivity. The intense heat and pressure generated by the rapidly burning chemical continues to provide the shock front to support the supersonic reaction. If the particle-burning rate fails to reach supersonic speed, the reaction will result in deflagration rather than detonation.

During deflagration the Ammonium Nitrate/Fuel Oil blasting agent still burns rapidly enough to make a huge volume of expanding gas, but deflagration does not produce the shock wave ahead to the reaction zone. Consequently, deflagration does not fracture the formation well and is characterized by orange Nitrogen Dioxide smoke. The Nitrogen Dioxide gas formation is the result of slow particle burning that happens at a detonation velocity 3,000 feet-per-second slower than the ideal velocity. Thus, the efficiency of the detonation reaction affects the effectiveness of the overall blast and the formation of pollutants.

Theoretically, detonation and deflagration can be depicted by mathematical formulas that describe the percent involvement of the chemical reaction. The fraction of the chemical reaction is proportional to the detonation velocity by the following equation:

$$N=(D/D^*)^2$$

Where N represents the Fraction of Reaction, D is the actual Detonation Velocity and D* is the ideal Detonation Velocity for the illustrated equation.

The ideal Detonation Velocity for ANFO is 15,600 feet-per-second. This is achieved in a 10-inch diameter hole, which will be assumed as the standard bore hole diameter for cast blasting as well as for this discussion. The following table illustrates how the Fraction of Reaction is affected by a 3,000 feet-per-second decrease from ideal Detonation Velocity.

| D | D/D* | N = (D/D*)2 |
|---|---|---|
| 15,600 | 100% | 100% |
| 14,600 | 94% | 88% |
| 13,600 | 87% | 77% |
| 12,600 | 81% | 66% |

A denotation velocity of 12,600 feet-per-second is the point of ANFO deflagration in a 10 inch bore hole and the result of only 66% of the blasting agent being completely reacted. The Fraction of the Reaction can further be related to the Grain Burning Theory equation as follows:

$$N=1-(1-t/T)^3$$

Where N represents the Fraction of Reaction, t is the Reaction Time, and T is the Grain Burning Time for the illustrated equation.

It was previously calculated from the detonation velocity, that deflagration occurs when the Fraction of the Reaction is only 66%. Using this 66% reaction rate as the point of deflagration it can be calculated that the particle burning rate is 3.33 times slower than optimum. This slowing in particle burning rate is calculated as follows:

$$1-(1-t/T)^3=0.65$$

$$(1-t/T)^3=0.35$$

$$(1-t/T)=0.70$$

$$t/T=0.30$$

| T | t/T | (1-t/T)3 | N = 1-(1-t/T)3 |
|---|---|---|---|
| 1 | 100% | 0% | 100% |
| 2 | 50% | 13% | 88% |
| 2.5 | 40% | 22% | 77% |
| 3.33 | 30% | 34% | 66% |

The factors the Fraction of Reaction are shown in the following table. The decrease from ideal detonation velocity is aligned with the decrease in particle burning rate to demonstrate their relationship to each other.

| Detonation Velocity | Grain Burning Rate Increase | Fraction of Reaction |
|---|---|---|
| 15,600 feet-per-second | Optimum | 100% |
| 14,600 feet-per-second | Particle burns 2 times slower | 88% |
| 13,600 feet-per-second | Particle burns 2.5 times slower | 77% |
| 12,600 feet-per-second | Particle burns 3.33 times slower | 66% deflagration |

The mathematical formulas can be used to demonstrate how the particle burning rate is related to the amount of related blasting agent and, in turn, how the reaction is related to the detonation velocity. It then becomes obvious that anything that slows the particle-burning rate and/or slows the detonation velocity affects the fraction of the reaction. Consequently, if the fraction of the reaction is only 66%, the powder column is in a state of deflagration and orange Nitrogen Dioxide smoke is produced.

In summary, to achieve detonation rather than deflagration, the reaction must be initiated at a supersonic rate and the particle-burning rate must maintain the supersonic reaction. That is why the energy of the booster is critical to optimum detonation. Therefore the initiation of an entire cross section of an explosives column to produce a steady state hydrodynamic shock wave at or near the bottom or area of the capsule in order to completely fire the column efficiently and sufficiently in order to reduce or eliminate the production of pollutants is desired in a shaped charge detonation system.

The detonation system is a shaped charge in the shell of a capsule designed to contain high energy blasting agent. The capsule may be filled and shipped as an explosive device or may be shipped as a capsule and filled with explosives at or near the site of blasting by the end user or blaster. In the event of shipping the capsule not filled with any explosive materials it does not qualify as a munitions, ordinance, pyrotechnic, bomb and or any other DOT Class 1 material so it may be shipped at a reasonable cost anywhere in the world. By allowing the end user or blaster to fill the capsule with an explosive of their choice, the cost is reduced. The design of the capsule reduces the need for complicated manufacturing and precision in the production of a shaped charge. Precise casting or filling of the capsule is not needed and can therefore be done by a blaster on-site. The blaster or end-user may be the explosives engineer, company or other entity responsible for setting and producing a blast.

The detonation system provides a plastic form referred to herein as a capsule. The detonation system is a shaped charge that utilizes a capsule to sufficiently, efficiently and effectively initiate a column of blasting agent. The filled capsule produces an initiation energy for a detonation of a column of blasting agent. The amount, shape and direction of the initiation energy is controlled by the capsule in order to efficiently and sufficiently react the blasting agent column for an effective blast. The filled capsule overcomes the conditions common in bore-holes such as contamination and corruption of the blasting agent and column, and the difficulties in the orientation of boosters and other initiators. The detonation system also addresses the need for a large quantity of explosives to sufficiently and properly initiate a column of blasting agent.

The capsule when filled forms a shaped charge from the explosive material contained inside the capsule. The capsule is made to contain 12 liters of high energy emulsified blasting agent for a 10-inch bore-hole. The capsule size may be modified to conform to other sizes of bore-holes. With smaller bore-holes the capsule will contain less blasting agent but provide the same results. The explosive contents of the capsule are to be initiated with a typical cast booster. However, other detonator means may be employed to initiate the contents of the capsule. The shape of the capsule then provides a shape to direct most of the initiation energy at the blasting agent column.

The detonation system utilizes a capsule which shapes detonation energy to assure hydrodynamic velocity is reached closer to the initial site of detonation of the explosive blasting agent column and to prevent the formation of pollutants in mining blasts. By ensuring the detonation reaches hydrodynamic velocity at or near the initial site of detonation, the capsule increases the efficiency of the blasting agent column to achieve the desired results of the blast. Additionally, focusing the energy of the initial detonation at the blasting agent ensures the powder column reaches hydrodynamic velocity and reduces deflagration, so it does not produce pollutants. The present invention provides a detonation system that can be used to solve the "orange smoke" problem in cast blasting.

The detonation system is designed to promote hydrodynamic velocity in bore-holes where the conditions of the blasting agent may be compromised. In the case of ANFO, the Ammonium Nitrate in the bore-hole has the potential to be affected by water, pressure, sulfide ore, temperature, loose geological structure, fissures and break up of the powder column. Wherever the conditions may require additional detonation energy, the capsule may be added to enhance the performance of the booster. The capsule may contain up to 30 pounds of explosives in order to provide sufficient energy to the powder column or column of blasting agent.

The detonation system is a technical solution to the environmental problem and thus a solution to keep the mining industry profitable. By initiating ANFO powder columns with concentrated energy, the formation of Nitrogen Dioxide is dramatically reduced. The detonation system is a plastic capsule that is to be filled with high energy blasting agent and fitted with a standard detonator means. The design of the capsule ensures that a large volume of blasting agent is protected from degradation and further ensures that the hydrodynamic velocity of the detonation is energetic enough to prevent Nitrogen Dioxide formation.

The detonation system is designed to address two other problems in the detonation of a bore-hole filled with blasting agent. The capsule is designed to protect up to 30 pounds of blasting agent from the affects of temperature, pressure, moisture and other adverse conditions at the bottom of the bore hole. The capsule further ensures that a commonly used cylindrical cast booster or other detonator means is in intimate contact with a sufficient amount of unadulterated blasting agent that will immediately initiate the powder column at hydrodynamic velocity. The capsule is shaped such that it projects the energy of the detonation directly at the column of blasting agent to spread the supersonic gas jet to the sides of the bore-hole. By providing the: assurance that the detonator system will initiate with maximum energy, the Ammonium Nitrate or other blasting agent will react completely and not form environmental pollutants. The capsule will protect and project the blast energy to ensure hydrodynamic velocity is obtained at the bottom of the blast hole or at the capsule location.

Figure 1:
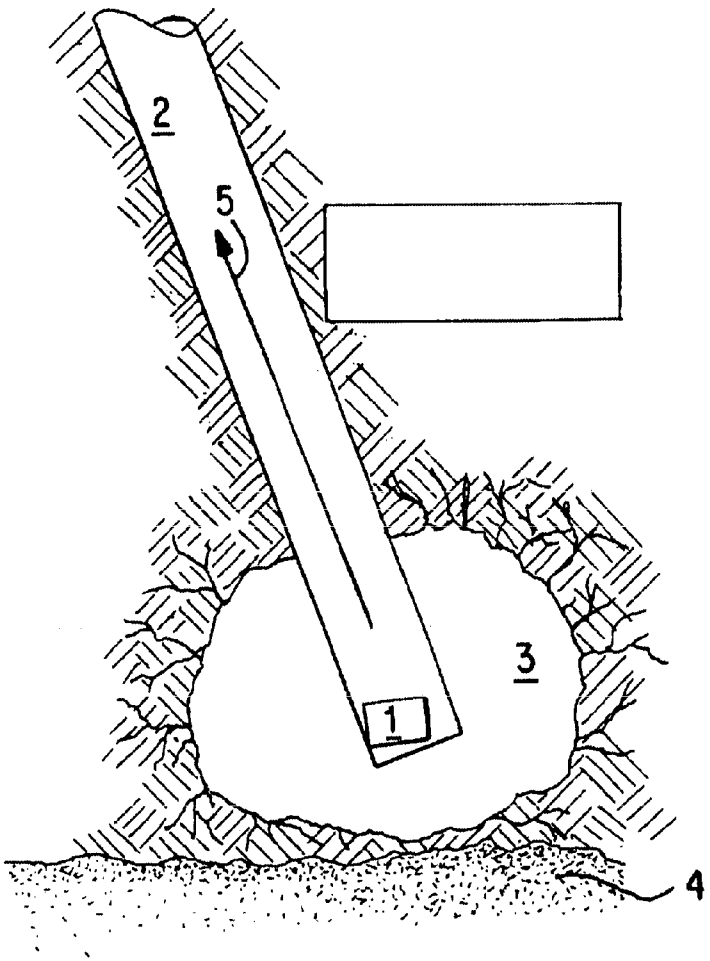
FIG. 1 is an illustration of a resultant blast initiated by a typical detonator.
Figure 3:
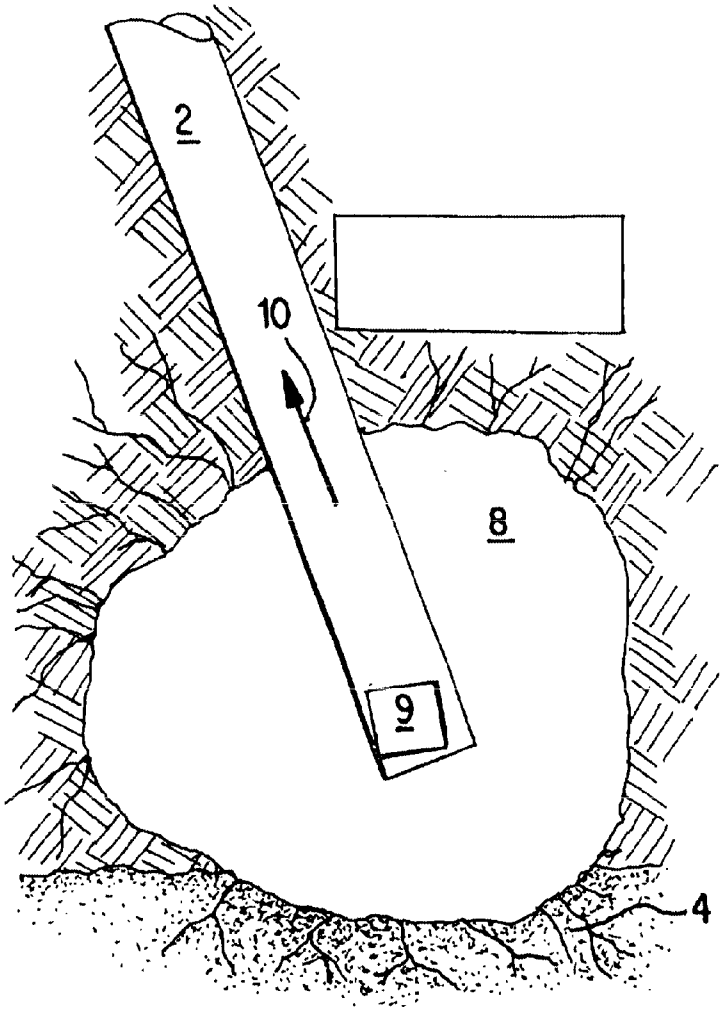
FIG. 3 is an illustration of a resultant blast initiated by a large booster.

A typical result of a blast 3 initiated with a one pound booster 1 in the bottom of a bore-hole 2 is shown in FIG. 1. A bore-hole 2 has been drilled to a pre-selected depth over mineral strata 4. A booster 1 is placed in the bottom of the bore-hole 2 in order to initiate a column of explosives placed over the booster. The one pound booster 1 provides an energy wave to initiate the column of explosives. The energy wave, however, is not sufficient enough to produce a steady state velocity shock wave near the bottom of the bore-hole. The shock wave typically reaches steady state velocity 5 in the borehole approximately forty feet from the booster or point of initiation. FIG. 2 shows a similar use of a shaped charge as described in prior art. The shaped charge 6 is located in the bottom of the bore-hole 2, but the shaped charge booster 6 may be misaligned because of the angle of the bore-hole 2. Typically, the shaped charge 6 produces an efficient shock wave, but due to the misalignment with the column of explosives the shock wave 7 does not achieve steady state velocity until it has traveled approximately twenty-five feet from the bottom of the bore-hole 2 or point of initiation. FIG. 3 shows a typical result 8 of a ten pound booster 9 used for initiation. The shock wave 10 attains steady state velocity closer to the bottom of the hole, around ten feet from the bottom or point of initiation, but the increased energy is not properly directed at the column of explosives and the mineral strata 4 is often damaged along with the other bore-holes not yet initiated. Typically, prior art boosters are small due to the explosives used and economic efficiency. Additionally, if a prior art booster was composed of 25 pounds of pentolite or other explosives normally used in boosters, the resulting initiation explosion would be too large and would result in damage to other bore-holes and mineral strata.

Figure 4:
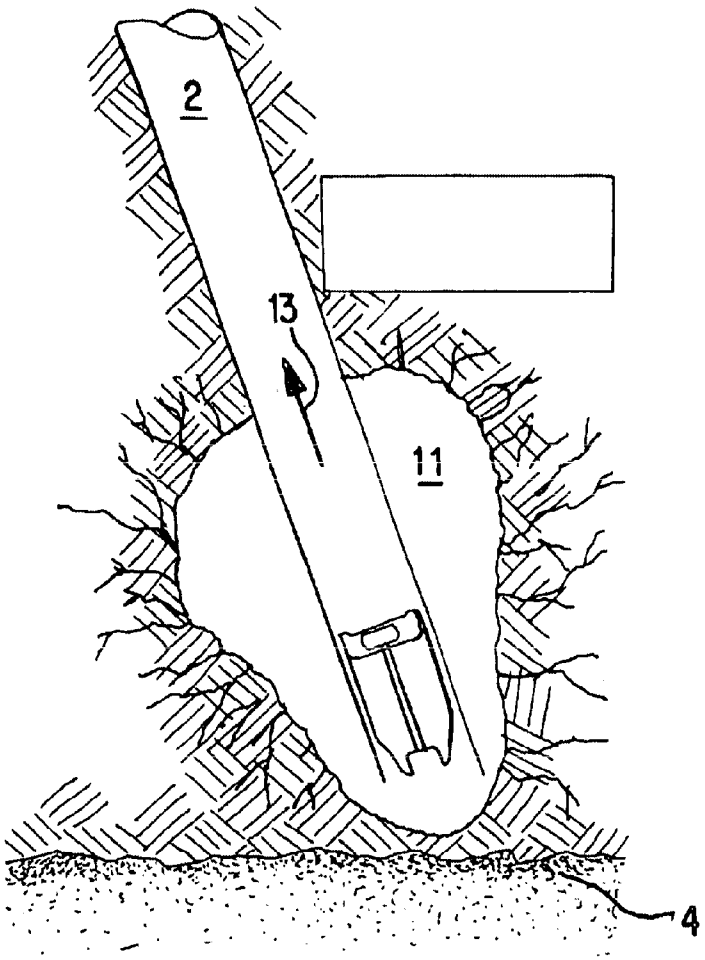
FIG. 4 is an illustration of a resultant blast initiated by the present invention.

The result 11 of using the present invention for initiation of a column of explosives in a bore-hole 2 is shown in FIG.4. The capsule 12 filled with explosives is properly oriented at the bottom of the bore-hole 2. The result 11 of the shaped charge sufficiently and efficiently initiates the column of explosives and the shock wave 13 reaches steady state velocity extremely close to the bottom of the bore-hole 2 or point of initiation. Even though, a large amount of explosives is used in the capsule 12 the shaped charge directs most of the energy up and into the powder column thereby minimizing the damage to the mineral strata 4 and other bore-holes.

Figure 5:
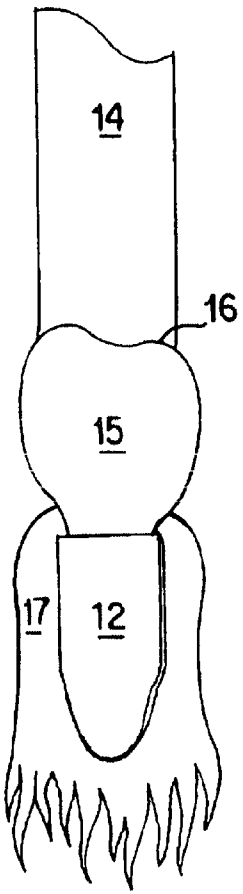
FIG. 5 is an illustration of a desired initiated shock wave from the present invention.

The dynamics of the shock wave or reaction interface are shown in FIG. 5. The capsule 12 filled with explosives is detonated thereby producing a sufficient amount of energy to efficiently initiate the blasting agent powder column 14. The shaped charge of the capsule initiates a reaction or detonation of the blasting agent near the top of the capsule 12. The detonation shock wave 15 is spread across the entire cross-section of the powder column 14 and produces a reaction interface 16 that travels up the powder column 14. The resultant supersonic high pressure interface shock wave 15 drives the blasting agent powder column 14 to detonation. The result of the efficient detonation is a high temperature volume of expanding gas 17 that affects the desired results of the blast.

The capsule is circular in cross-section. A sturdy collar around the circumference of the capsule shapes the blast energy into a supersonic jet of energy that uniformly ignites the circular cross-section powder column. The body of the capsule has a gradual taper at a 13 to 18-degree angle from the capsule centerline, to form the shaped charge and shape the energy as it is created by the high-energy explosive that fills the capsule. Preferably, the taper of the capsule is a 17 degree angle. The angle is remarkably critical in the design because it creates greater energy than does a straight-sided cylinder. This angle assists in spreading the jet of exploded gases to the sides of the bore-hole such that steady state velocity will be obtained as quickly as possible, without having to have the capsule the same diameter as the bore-hole. Typically, the capsule will have a ¼ to 1 inch clearance between the sides of the capsule and the sides of the bore-hole. The angle also provides the shaped charge with a proper shape to sufficiently initiate the entire cross-section of the powder column to achieve a shock wave that initiates the outer circumference of the powder column as well. Without the angle, the shock wave does not spread to an even burn and results in an underpowered condition.

Figure 6B:
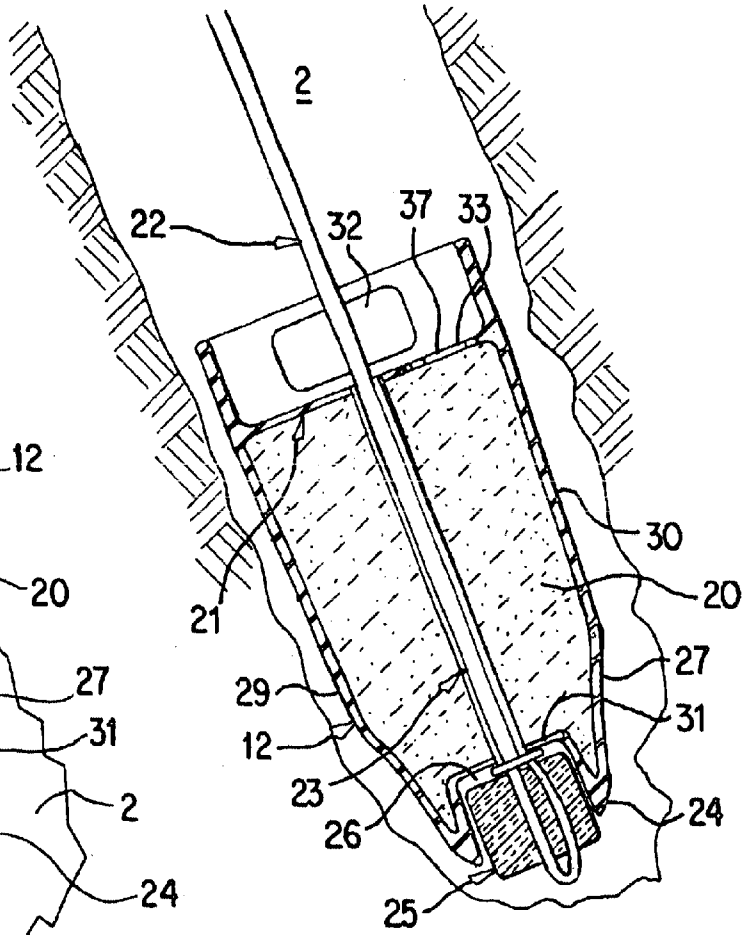
FIG. 6*b* is a sectional view of a bore-hole locating another capsule according to another form of the present invention.
Figure 6A:
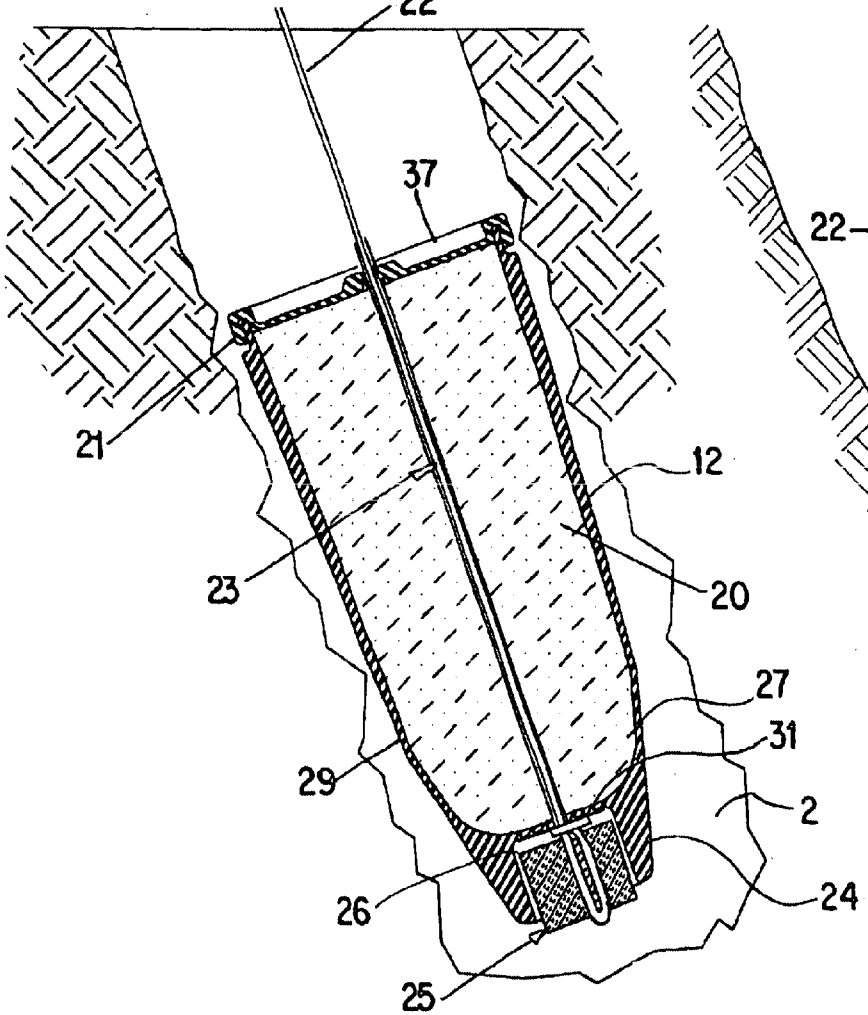
FIG. 6*a* is a sectional view of a bore-hole locating a capsule according to one form of the present invention.
Figure 7A:
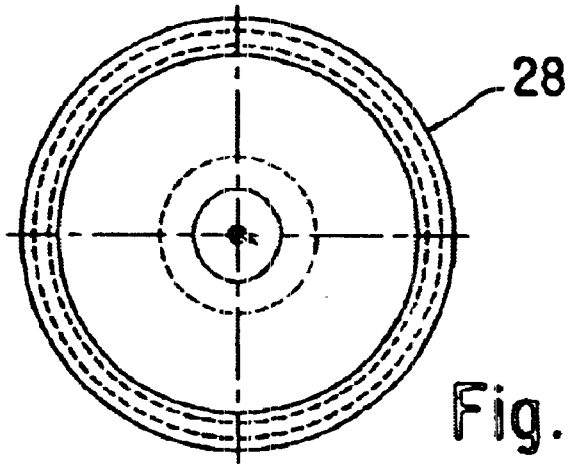
FIG. 7*a* is a sectional side view of a capsule according to one form of the present invention.
Figure 7B:
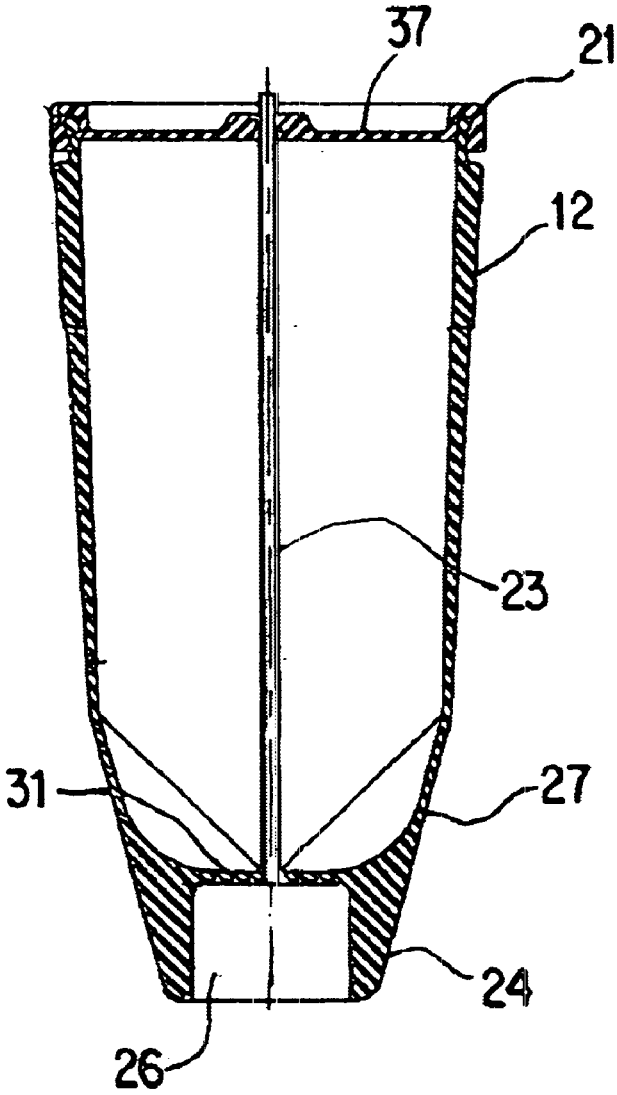
FIG. 7*b* is a top view of a capsule according to one form of the present invention.
Figure 8C:
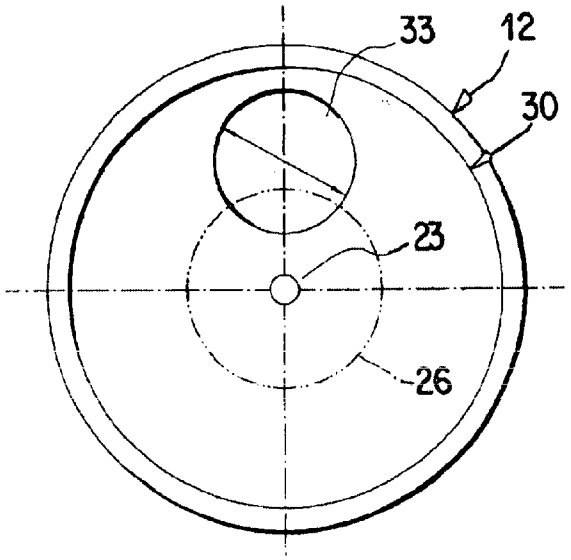
FIG. 8*c* is a top view of a capsule according to another form of the present invention.
Figure 8B:
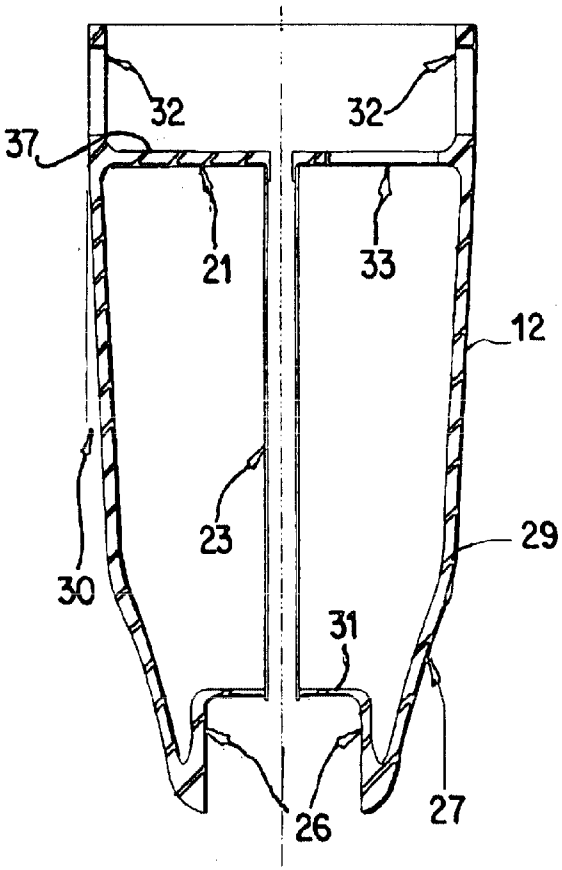
FIG. 8*b* is a further sectional side view of a capsule according to another form of the present invention.
Figure 8A:
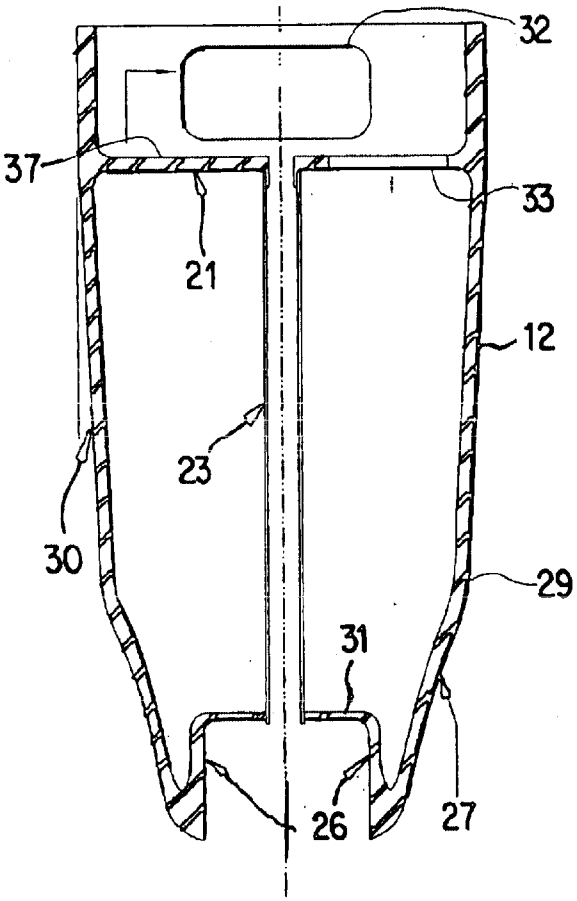
FIG. 8*a* is a sectional side view of a capsule according to a form of the present invention.

A filled capsule 12 is placed down a bore-hole 2 in FIG. 6*a*. The capsule 12 was filled with explosive material 20 by the blaster and sealed with a snap-fit lid 21 to produce a water-tight seal as shown in FIG. 7. The blaster or user then threads detonation cord means 22 to initiate the detonation through the tube 23 located in the center of the capsule 12. The tube 23 provides a barrier between the detonation cord means 22 and the explosive material 20 contained within the capsule 12. The detonation cord means 22 is then pulled through the tapered end 24 of the capsule and passed through a detonator means 25. The detonation cord means 22 is then pulled taught and the detonator means 25 is located in the recess 26 at the tapered end 24 of the capsule 12. The capsule 12 is then lowered into the bore-hole 2 tapered end 24 down. The rounded end of the tapered end 24 of the capsule 12 allows the capsule 12 to be easily passed down the bore-hole 2. The angled sides 27 of the capsule 12 above the recess 26 is the angle to produce efficient detonation by way of shaping the detonation wave. The angled sides 27 of the capsule are angled outward and upward from the bottom of the capsule 12. The sides of the capsule from the bottom of the capsule 12 to the region of the upper part of the recess 26 are angled to allow the capsule to easily slide down a bore-hole and forms the tapered end 24. The sides of the capsule 12 from the upper region of the recess 26 are angled to shape the detonation wave and form the angled sides 27 of the capsule. This shaped angle is between 13 and 18 degrees. Preferably, the shaped angle is 17 degrees to shape the detonation wave. The sides of the capsule 12 continue at the shaped angle until the maximum diameter 28. Above the shaped angle, the sides 29 of the capsule are straight or not angled from the shaped angle to the top or lid 21 of the capsule. In a preferred embodiment, shown in FIG. 6*b* and 8*a*–8*c*, the angled sides 27 of the capsule are at the shaped angle, and then the sides 29 are reduced in angle to a 3 or 4 degree draft 30. The sides of the capsule have a draft 30 from the shaped angle to the top of the capsule or lid 21. The draft 30 further shapes the detonation wave and spreads the detonation to the entire cross-section of the blasting agent column 2.

Within the capsule is a recession 26 into which a typical cylindrical booster will fit. A cylindrical booster may be used for detonation of the explosives in the capsule, but other detonator means 25 may be used to detonate the explosive material 20 in the capsule 12. The recession 26 is separated from the cavity of the capsule by a thin plastic wall 31. The wall 31 is thinner than the rest of the capsule shell so the explosion can easily ignite into the explosive material 20 or blasting media inside the capsule 12. The detonator means recession 26 is orientated at the tapered end 24 of the capsule. The recession 26 is remarkable in the design because it acts to prevent lateral energy loss from the booster by encouraging the energy to follow the upward path of least resistance. The capsule shell may be thicker radially surrounding the recession 26. The tapered end 24 of the capsule is oriented down the bore-hole 2 and typically is located at the bottom of a bore-hole 2.

When the capsule is lowered into the bore-hole a blasting agent is then placed on top of the capsule and fills the bore-hole to the desired level. The capsule 12 as shown in FIG. 6*a* has a tube 23 or passage which is located through the center of the capsule 12, and the capsule lid 21 forms a watertight seal with the tube 23 to protect the contents of the capsule. The lid 21 has a bevel at the tube 23 passage to ensure the seal. The tube 23 also forms a water tight seal at the bottom of the capsule at the recess 26. The tube may also be a plunger means to initiate the detonator means 25.

The capsule design incorporates a passage tube. 23 from the flat end of the capsule to the booster recession 26. The passage is used to attach detonation cord means 22 and non-electric initiation to the booster. Preferably, the passage is 0.75 inches to accommodate several known types of detonation cord. The tube 23 acts to confine the burning of the detonation cord means 22 so that it does not prematurely ignite the confined blasting media inside the capsule before the booster initiates. The tube 23 is placed longitudinally through the capsule and symmetrically centered from top to bottom.

Preferably, the flat end 37 of the capsule is designed with a recessed hand-hold 32 and a 4-inch opening 33 through which the high energy-blasting agent is added to the capsule. The opening 33 is sealed with a bung after filling. When sealed the system is watertight. The capsule may be a continuous molded piece for strength, or the capsule may also employ a snap-fit lid 21 in order to add or fill the capsule with explosives. The handhold 32, in the top of the capsule allows the container to be up righted so the detonation cord means 22 can be threaded through the longitudinal tube. The detonation cord means 22 is then threaded through the booster, knotted and pulled into the recession 26. The cord is used to lower the capsule down the bore-hole. It may be desirable to attach non-electric detonation to the booster but a detonation cord is used to support the weight of the loaded capsule. Other support means may be used to lower the capsule into the bore-holes. The capsule is fitted with a handhold and a rope or other support means may be tied to the handhold for lowering.

FIG. 6*b* shows a preferred embodiment of the capsule 12 in a bore-hole 2. The capsule 12 is filled with explosive material 20 through a fill hole 33 at the top of the capsule 12. The fill hole 33 is then sealed with sealing means. Preferably, the sealing means is a bung that can be removed after filling the capsule 12 but produces a sufficient seal. In a preferred embodiment, the capsule is manufactured to form one piece. The tube 23 or passage for the detonation cord means 22 is integral with the structure of the capsule and no sealing means is needed at the top or bottom of the capsule 12 for the tube 22 or passage. Internal baffles may be present to provide structural support for the capsule. The explosive material 20 completely fills the capsule 12 and surrounds the recess 26 at the bottom of the capsule. The shaped angle of the angled sides 27 of between 13 to 18 degrees is provided at the bottom of the capsule, and the sides of the capsule extend upward and outward at the shaped angle. Above the shaped angle, the capsule sides further extend upward and outward at a draft 30 of between 3 to 4 degrees. The top of the capsule is provided with handholds 32 for ease in transportation and handling. The handholds 32 also provide an alternative or secondary means to support the capsule when lowered into the bore-hole. The capsule in the bore-hole has a narrow clearance on each side of the capsule. Preferably, the clearance between the capsule sides and the bore-hole sides is 0.5 inches to allow the capsule to be easily lowered yet still allow the maximum area of the top of the capsule to contact the cross-section of the powder column.

The detonation means is placed in the recess and tied or threaded with the detonation cord means. The detonation means extends into the recess of the capsule. Preferably, the capsule wall above the recess is thinner to allow the energy of the detonation means to penetrate into the interior of the capsule and come in contact with the explosives therein.

Chemistry of Nitrogen Oxide Formation in ANFO Detonation

The idea that Nitrogen Oxide formation can be stopped with a shaped energy detonation is novel to the present invention. Consequently, this disclosure reviews the chemistry for the creation of Nitrogen Oxides from ANFO blasts and how detonation energy solves the problem.

The balanced chemical equations that can occur between Ammonium Nitrate and hydrocarbon (fuel oil) have been written out to help better understand the system. In the case of an ANFO explosion the hydrocarbon components are oxidized to form Carbon Dioxide and water, while the Ammonium Nitrogen is oxidized to Nitrogen. This oxidation occurs because the Nitrate Nitrogen is reduced to Nitrogen. This balanced chemical reaction is that of ANFO detonation:

1) Detonation to Carbon Dioxide Formation:

$$3NH_4NO_3 + CH_2 \rightarrow 3N_2 + CO_2 + 7H_2O$$

| chemical | moles | reactant | moles | product | electrons |
|---|---|---|---|---|---|
| $NH_4^+$ = | 3 | $N^{-3} \rightarrow$ | 3 | $N^0$ − | 9 e− |
| $NO_3^-$ = | 3 | $N^{+5} \rightarrow$ | 3 | $N^0$ + | 15 e− |
| $CH_2$ = | 1 | $C^0 \rightarrow$ | 1 | $C^{+4}$ − | 4 e− |
| $CH_2$ = | 2 | $H^0 \rightarrow$ | 2 | $H^{+1}$ − | 2 e− |

It is the Nitrate ion reduction that drives the oxidation of the hydrocarbon. That is why any Nitrate salt works to oxide a hydrocarbon; the Nitrate Nitrogen does the work as shown by the follow reaction between Calcium Nitrate and a hydrocarbon:

2) Detonation to Carbon Dioxide Formation:

$$3Ca(No_3)_2 + 5CH_2 \rightarrow 3N_2 + 5CO_2 + 5H_2O + 3CaO$$

| chemical | moles | reactant | moles | product | electrons |
|---|---|---|---|---|---|
| $NO_3^-$ = | 6 | $N^{+5} \rightarrow$ | 6 | $N^0$ + | 30 e− |
| $CH_2$ = | 5 | $C^0 \rightarrow$ | 5 | $C^{+4}$ − | 20 e− |
| $CH_2$ = | 10 | $H^0 \rightarrow$ | 10 | $H^{+1}$ − | 10 e− |

Understanding the role of the Nitrate ion is key to understanding the formation of Nitrogen Oxide from Ammonium Nitrate. Even when there is insufficient hydrocarbon fuel the chemical reaction can still be satisfied by using the Ammonium ion of the Ammonium Nitrate as the fuel. The deflagration reaction occurs when the Ammonium Nitrate becomes both the fuel and oxidizer. The next three chemical equations show how the Ammonium Nitrate can self oxidize to form Nitrous Oxide, Nitric Oxide and Nitrogen Dioxide:

3) Deflagration to Nitrous Oxide Formation:

$NH_4NO_3 \rightarrow N_2O + 2H_2O$

| chemical | moles | reactant | moles | product | electrons |
|---|---|---|---|---|---|
| $NH_4^+$ = | 1 | $N^{-3} \rightarrow$ | 1 | $N^{+1}$ − | 4 e− |
| $NO_3^-$ = | 1 | $N^{+5} \rightarrow$ | 1 | $N^{+1}$ + | 4 e− |

4) Deflagration to Nitric Oxide Formation:

$2NH_4NO_3 \rightarrow N_2 + 2NO + 4H_2O$

| chemical | moles | reactant | moles | product | electrons |
|---|---|---|---|---|---|
| $NH_4^+$ = | 1 | $N^{-3} \rightarrow$ | 1 | $N^0$ + | 3 e− |
| $NH_4^+$ = | 1 | $N^{-3} \rightarrow$ | 1 | $N^{+2}$ + | 5 e− |
| $NO_3^-$ = | 1 | $N^{+5} \rightarrow$ | 1 | $N^0$ − | 5 e− |
| $NO_3^-$ = | 1 | $N^{+5} \rightarrow$ | 1 | $N^{+2}$ − | 3 e− |

5) Deflagration to Nitrogen Dioxide Formation:

$4NH_4NO_3 \rightarrow 3N_2 + 2NO_2 + 8H_2O$

| chemical | moles | reactant | moles | product | electrons |
|---|---|---|---|---|---|
| $NH_4^+$ = | 3 | $N^{-3} \rightarrow$ | 3 | $N^0$ + | 9 e− |
| $NH_4^+$ = | 1 | $N^{-3} \rightarrow$ | 1 | $N^{+4}$ + | 7 e− |
| $NO_3^-$ = | 3 | $N^{+5} \rightarrow$ | 3 | $N^0$ − | 15 e− |
| $NO_3^-$ = | 1 | $N^{+5} \rightarrow$ | 1 | $N^{+4}$ − | 1 e− |

The point being made is that deflagration is supported when there is absence of another source of fuel to oxidize other than the Ammonium ion. In the case of Ammonium Nitrate, the two different valance states of Nitrogen, within the same molecule, allow one species to be oxidized while the other is reduced.

If the Ammonium Nitrate is over oiled the reaction favors the formation of Carbon Monoxide rather than Carbon Dioxide. This chemical species is also unwanted in the environment but goes without detection because it is colorless. This detonation reaction occurs by the following equation:

6) Detonation to Carbon Monoxide Formation:

$2NH_4NO_3 + CH_2 \rightarrow 2N_2 + CO + 5H_2O$

| chemical | moles | reactant | moles | product | electrons |
|---|---|---|---|---|---|
| $NH_4^+$ = | 2 | $N^{-3} \rightarrow$ | 2 | $N^0$ − | 6 e− |
| $NO_3^-$ = | 2 | $N^{+5} \rightarrow$ | 2 | $N^0$ + | 10 e− |
| $CH_2$ = | 1 | $C^0 \rightarrow$ | 1 | $C^{+2}$ − | 2 e− |
| $CH_2$ = | 2 | $H^0 \rightarrow$ | 2 | $H^{+1}$ − | 2 e− |

An attempt was made to calculate the free energy for all of the ANFO chemical reactions. The table shows a numerical representation for each reaction ΔG at a blast temperature of 4,750 degrees Fahrenheit:

| | | |
|---|---|---|
| Detonation #1 | $NH_4NO_3 + \frac{1}{3}CH_2 \rightarrow N_2 + \frac{1}{3}CO_2 + \frac{7}{3}H_2O$ | −1,736 kJ/kg |
| Detonation #2 | $NH_4NO_3 + CH_2 \rightarrow N_2 + \frac{1}{2}CO + \frac{5}{2}H_2O$ | −1,716 kJ/kg |

-continued

| | | |
|---|---|---|
| Deflagration #1 | $NH_4NO_3 \rightarrow \frac{1}{2}N_2 + NO + 2H_2O$ | −1,584 kJ/kg |
| Deflagration #2 | $NH_4NO_3 \rightarrow \frac{3}{4}N_2 + \frac{1}{2}NO_2 + 2H_2O$ | −1,532 kJ/kg |
| Deflagration #3 | $NH_4NO_3 \rightarrow N_2O + 2H_2O$ | −1,340 kJ/kg |

Since all the possible reactions involving Ammonium Nitrate have negative free energy the potential exists for any of the reactions to occur. The most favored reaction has been termed detonation #1. This reaction occurs when the molar ratio of Ammonium Nitrate to fuel oil is stoichiometrically balanced at a 3 to 1 ratio. That molar ratio equates to adding 5.8 weight percent fuel oil to the Ammonium Nitrate (14 grams/240 grams). If the oxidizer to fuel ratio is less than 3/1 it will favor the reaction called detonation #2 and produce Carbon Monoxide if the oxidizer to fuel ratio is greater than 3/1 there will be deflagration to form Nitrogen Oxides. Thermodynamically the formation of Nitric Oxide and Nitrogen Dioxide are about the same but the orange cloud is attributable to the colored Nitrogen Dioxide gas.

The fact that under oiling ANFO produces Nitrogen Dioxide and over oiling ANFO produces Carbon Monoxide is nothing new. Consequently, the key to not forming Nitrogen, Oxides is to keep the fuel to oxidizer ratio stoichiometric. This does not necessarily mean just as the ANFO is mixed but also as it is ignited. Research shows that loss of confinement is the single greatest contributing factor to the formation of Nitrogen Oxides; consequently, loss of confinement means loss of fuel. It is theorized that the hydrocarbon vaporizes away from the Ammonium Nitrate when confinement is lost and/or the hydrocarbon vaporizes at a different rate than the Ammonium Nitrate when confinement is lost. Either way, the resolve for the problem is to retain confinement, put in a fuel that does not vaporize as quickly as diesel fuel or make the reaction so fast there is no time for the fuel to escape the oxidizer.

Thus, the reaction of the ANFO is controlled by ensuring a hydrodynamic velocity or steady state velocity reaction through the ANFO column, and the hydrodynamic velocity or steady state velocity reaction is ensured by shaping the initiation detonation energy and directing it at the entire cross-section of the ANFO column. Thereby, the pollutants associated with a blast are controlled through an efficient and sufficient shaped charge detonation system.

The use of a capsule to enhance the detonation system addresses many concerns. The capsule prevents damage to the blasting agent that is in immediate contact with the booster. The capsule protects up to 30 pounds of high-energy explosive from dissolving, phase separating, dissociating into the formation and/or becoming stoichiometrically imbalance for any other unforeseen reason. An added benefit of the capsule is that it also promotes confinement by not damaging the bottoms of the bore-holes. Instead of a symmetrical sphere of blast energy emanating from an unconfined booster, the capsule confines the booster so it does not lose lateral energy to the adjacent bore-holes. It can be envisioned that the shock wave from each explosion pummels the bore-holes in the next row, causing loss of confinement. The further back in the drilling pattern the hole is the more shock it has received before it is detonated. This can be minimized by confining the lateral shock energy transmitted at the bottom of each bore-hole, and this confinement is addressed in the design of the capsule.

The final benefit of the capsule is to shape the detonation to ignite a blasting agent column. By shaping the detonation with the capsule, opposed to shaping a detonation with the present art, it is guaranteed that the charge will have correct orientation even in a severely angled hole. The capsule provides the power of several detonators, while directing the energy so it does not damage the mineral strata.

I claim:

1. A shaped charge detonation device with a shaped charge of explosive material used to initiate a column of blasting agent, said shaped charge detonation device comprising: a capsule filled with the explosive material, said capsule having a shape to direct an initiation energy towards the column of blasting agent, said capsule shape including a tapered end, a substantially flat end opposite the tapered end and a passage from the flat end to the tapered end through a center of the capsule with a tube located in the passage, said capsule being formed from a plastic material, a detonator for initiating the explosive material, and a detonation cord to initiate the detonator.

2. A shaped charge detonation device with a shaped charge of explosive material used to initiate a column of blasting agent, said shaped charge detonation device comprising:

a capsule filled with the explosive material, said capsule having a shape to direct an initiation energy towards the column of blasting agent, said capsule shape including a tapered end, a substantially flat end opposite the tapered end and a passage from the flat end to the tapered end through a center of the capsule with a tube located in the passage, said capsule being formed from a plastic material, a detonator for initiating the explosive material, and a detonation cord to initiate the detonator, wherein the capsule includes a recess in the tapered end for the detonator.

3. A shaped charge detonation device according to claim 1, wherein the detonator is a cast booster.

4. A shaped charge detonation device according to claim 3, wherein the detonator is a cylindrical cast booster.

5. A shaped charge detonation device according to claim 1, wherein the capsule shape is substantially cylindrical.

6. A shaped charge detonation device according to claim 1, wherein the capsule shape includes an outer shape and an inner shape, the outer shape includes the tapered end to allow the capsule to be lowered past obstructions in a borehole, and the inner shape includes the shape to direct the initiation energy.

7. A shaped charge detonation device according to claim 6, wherein the capsule shape includes angled sides.

8. A shaped charge detonation device according to claim 7, wherein the angled sides are angled between 13 to 18 degrees.

9. A shaped charge detonation device according to claim 8, wherein the angled sides are angled between 16 to 17 degrees.

10. A shaped charge detonation device according to claim 7, wherein the capsule shape includes draft sides above the angled sides, the draft sides are angled between 3 to 4 degrees.

11. A shaped charge detonation device with a shaped charge of explosive material used to initiate a column of blasting agent, said shaped charge detonation device comprising:

a capsule filled with the explosive material, said capsule having a shape to direct an initiation energy towards the column of blasting agent, said capsule shape including a tapered end, a substantially flat end opposite the tapered end and a passage from the flat end to the tapered end through the capsule with a tube located in the passage, said capsule being formed from a plastic material, a detonator for initiating the explosive material, and a detonation cord to initiate the detonator, wherein the capsule includes a recess in the tapered end for the detonator, and wherein the plastic material of the capsule above the recess is thinner than other areas of the capsule.

12. A shaped charge detonation device according to claim 1, wherein the tapered end is frustoconical.

13. A shaped charge detonation device according to claim 1, wherein the capsule includes a watertight lid.

14. A shaped charge detonation device according to claim 1, wherein the capsule is formed in one piece.

15. A shaped charge detonation device according to claim 14, wherein the capsule includes a sealable fill hole in the flat end.

16. A shaped charge detonation device according to claim 1, wherein the capsule has a diameter at the flat end substantially equal to a diameter of the column of blasting agent.

17. A shaped charge detonation device according to claim 14, wherein the tube is integral with the capsule.

18. A shaped charge detonation device according to claim 1, wherein the capsule includes handholds located at the flat end.

19. A shaped charge detonation device according to claim 1, wherein the capsule contains between 20 to 30 pounds of the explosive material.

20. A shaped charge detonation device according to claim 19, wherein the capsule contains between 23 to 27 pounds of the explosive material.

21. A shaped charge detonation device according to claim 1, wherein the explosive material and the blasting agent are like materials.

22. A shaped charge detonation device according to claim 1, wherein the blasting agent is Ammonium Nitrate/Fuel Oil.

23. A shaped charge detonation device according to claim 1, wherein said capsule includes internal baffles to strengthen the capsule.

24. A shaped charge detonation device according to claim 1, wherein said capsule is formed of plastic.

25. A shaped charge detonation device comprising:

a shaped charge of an explosive material contained within a capsule which operatively releases an initiation energy upwardly into a column of blasting agent in order to ensure a resultant detonation reaction attains steady state velocity of detonation in the blasting agent column close to the shaped charge device and thereby prevent deflagration of the blasting agent, said capsule, a detonator for initiating the explosive material, and a detonation cord for initiating the detonator, wherein the capsule provides a shape of the shaped charge which operatively reduces emissions of Nitrogen Oxides from detonation of the blasting agent column, and wherein the capsule has a snap-fit lid for sealing and a tube with open ends through a centerline for a passage for the detonation cord.

26. A shaped charge detonation device according to claim 25, wherein said capsule contains between 20 to 30 pounds of the explosive material.

27. A shaped charge detonation device according to claim 25, wherein the capsule has angled sides to form the shaped charge to direct the initiation energy upwardly into the column of blasting agent and across an entire cross-section of the column of blasting agent.

28. A shaped charge detonation device according to claim 27, wherein said angled sides located above the tapered end continue outwardly and upwardly at between 13 to 18 degrees from the capsule centerline.

29. A shaped charge detonation device according to claim 25, wherein the capsule has a tapered end to guide the capsule past obstructions when lowered down a borehole.

30. A shaped charge detonation device according to claim 29, wherein said tapered end has a recess for the detonator.

31. A shaped charge detonation device according to claim 1, wherein the detonation cord is capable of passing through the tube to operatively connect with the detonator.

* * * * *